US006435674B1

(12) United States Patent
Michele et al.

(10) Patent No.: US 6,435,674 B1
(45) Date of Patent: Aug. 20, 2002

(54) INK CARTRIDGE FOR AN INKJET PRINTING SYSTEM

(75) Inventors: Helmut Michele, Catrop-Rauxel; Dirk Klein, Hagen; Peter Busch, Bochum, all of (DE)

(73) Assignee: Artech GmbH Design + Production in Plastic, Dortmund (DE)

( * ) Notice: Subject to any disclaimer, the term of this patent is extended or adjusted under 35 U.S.C. 154(b) by 0 days.

(21) Appl. No.: 09/677,371

(22) Filed: Sep. 12, 2000

(30) Foreign Application Priority Data

Sep. 14, 1999 (DE) ..... 199 43 947

(51) Int. Cl.[7] ..... B41J 2/175
(52) U.S. Cl. ..... 347/86
(58) Field of Search ..... 347/86, 87, 85, 347/84; 277/627, 628; 215/247, 355; 220/277

(56) References Cited

U.S. PATENT DOCUMENTS 4,431,698 A * 2/1984 Case et al. ..... 428/244
5,719,609 A * 2/1998 Hauck et al. ..... 347/85
5,790,158 A 8/1998 Shinada et al. ..... 347/86
6,276,785 B1 * 8/2001 Shinada et al. ..... 347/86

FOREIGN PATENT DOCUMENTS

EP 1 084 850 * 3/2001

* cited by examiner

*Primary Examiner*—John Barlow
*Assistant Examiner*—Michael Nghiem
(74) *Attorney, Agent, or Firm*—Hoffman, Wasson & Gitler PC

(57) ABSTRACT

An ink cartridge for an inkjet printing system, having an extraction opening closed off by a membrane that is made of thermoplastic elastomer and that can be pierced by a hollow needle when inserted into the inkjet printing system. In order to ensure that the hollow needle penetrates with certainty in the short insertion path available in the dome, the membrane is made of a thermoplastic elastomer that has an elongation at tear that is reduced by the addition of inelastic, inorganic substance.

11 Claims, 1 Drawing Sheet

INK CARTRIDGE FOR AN INKJET PRINTING SYSTEM

FIELD OF THE INVENTION

The present invention pertains to an ink cartridge for an inkjet printing system, having an extraction opening closed off by a membrane that is made of thermoplastic elastomer, which can be pierced by a hollow needle when inserted into the inkjet printing system. A method for the manufacture of such an ink cartridge is also an object of the invention.

PRIOR ART

Supplying ink to inkjet printers and plotters is carried out by means of a hollow needle in the form of a tubular, protruding arbor that can be brought into contact with the ink-filled interior of replaceable, disposable ink cartridges that serve as reservoirs. As a rule, configured into the ink cartridge to seat this arbor is a tube section, the so-called dome. The latter is closed off at its inward-directed opening by a fine-mesh filter screen. The external opening is provided with sealing means for the sealed seating of the abovementioned hollow needle or arbor. Used as an alternative to this are ring seals with a preformed opening for seating the hollow needle—as known from U.S. Pat. No. 5,790,158, for example—or else a membrane that is closed off at first, and can then be pierced by the hollow needle. This membrane is made of an elastic material such as thermoplastic elastomers or rubber materials, so that an arbor inserted into it is sealed towards the outside when in the recessed opening. Such executions function in the manner of a septum, such as those that have long been common on sample bottles for the removal of sample liquids by means of injection syringes, and are therefore synonymously known as septums or membranes.

One advantage of using a membrane of this type that can be pierced is that the extraction opening is sealed off airtight, without additional packaging and safeguarding measures being necessary first. To ensure a good sealing of the hollow needle, a certain elasticity of the elastomer material is indispensable. High-quality elastomer materials not only meet these requirements, but they are also so highly elastic, having a maximum elasticity (elongation at tear) of 400% to 800%, that a safe and clean piercing by the printer's hollow needle becomes difficult. Specifically, the available insertion length of the hollow needle (the arbor), and the length of the dome that is matched to that, is limited to a few millimeters—5 mm, for example. For proper operation, it must now be assured that, with respect to material thickness and the elasticity of the material, the membrane in the piercing region is matched in such a way that the needle always pierces the membrane before maximum immersion into the dome, but also that the normal forces exerted on the membrane do not become so large that the membrane is squeezed into the dome, possibly making the ink cartridge unusable. This effect is reinforced by the fact that the commonly available arbors or hollow needles do not have especially sharp points, just for safety reasons. For that reason, the use of the known, highly elastic elastomer materials is often problematic.

Resulting from the solution to the problem explained above is the task that forms the basis of the invention, i.e., to make available a membrane or septum for an ink cartridge, which can be pierced with certainty, and specifically, even with a relatively dull needle and a relatively short motion path that is available. In conjunction with that, the sealing is to be assured as well.

To solve this problem, the invention suggests that the membrane be made of a thermoplastic elastomer that has an elongation at tear that is reduced by means of added inelastic, inorganic substances.

SUMMARY OF THE PRESENT INVENTION

According to the invention, the membrane is still produced from a thermoplastic elastomer material by means of injection molding. However, the characteristic feature of the material lies in the fact that the elongation at tear, i.e., the maximum elasticity of the previously highly elastic elastomer, is purposely reduced through the addition of an inelastic, inorganic substance.

As a result of the inert, inelastic material that, according to the invention, is added to the elastomer, the degree of cross-linking is reduced, which results in reduced elongation at tear. The elongation at tear can be reduced through the addition of the relative proportion of the inorganic substance to such an extent that even a dull printer arbor penetrates the membrane with certainty, even with the relatively short insertion depth that is available.

A characteristic feature of the invention lies in the fact that it deliberately makes use of an effect, which is, on principle, otherwise undesirable and harmful in the use of elastomers, for an advantageous functionality under the conditions of this special application case. Although elongation at tear is usually optimized to values that are as high as possible, for the realization of the membrane according to the invention for an ink cartridge, a reduced value of about 100% for the elongation at tear has turned out to be especially favorable.

The use of talcum as the inelastic, inorganic substance is especially advantageous. However, chalk, silicic acid, silicates, carbonates oxides and similar materials can be used as well.

Fundamentally, it is advantageous if the inorganic substance contains particle-shaped solids. That way, the elastic properties of the material according to the invention are influenced not only by the properties of the elastomer according to the invention, but also by the particle size, the linkage forces between elastomer and the particles, and the mechanical properties of the inorganic substance that has been added, so that the desired reduction in elasticity can be matched to the given requirements in the best possible way. Especially advantageous in this regard is the fact that the Shore hardness of the original elastomer is largely retained, so that the sealing of the hollow needle continues to be assured.

The membrane advantageously has a ring-shaped part that is closed off by a piercing region with less material thickness. The ring- or bushing-shaped part is used for the installation in the tubular dome of the ink cartridge, while the region surrounded by this ring-shaped structure is configured as thin as film so that it is easily pierced by the arbor during insertion. Because of its greater material thickness, the ring-shaped structure exerts an elastic retaining force large enough that the membrane is securely fixed in place in the opening of the dome and is not displaced as it is pierced by the arbor.

BRIEF DESCRIPTION OF THE DRAWINGS

The FIGURE is an illustration of the present invention.

DETAILED DESCRIPTION OF A PREFERRED EMBODIMENT

Figure 1:
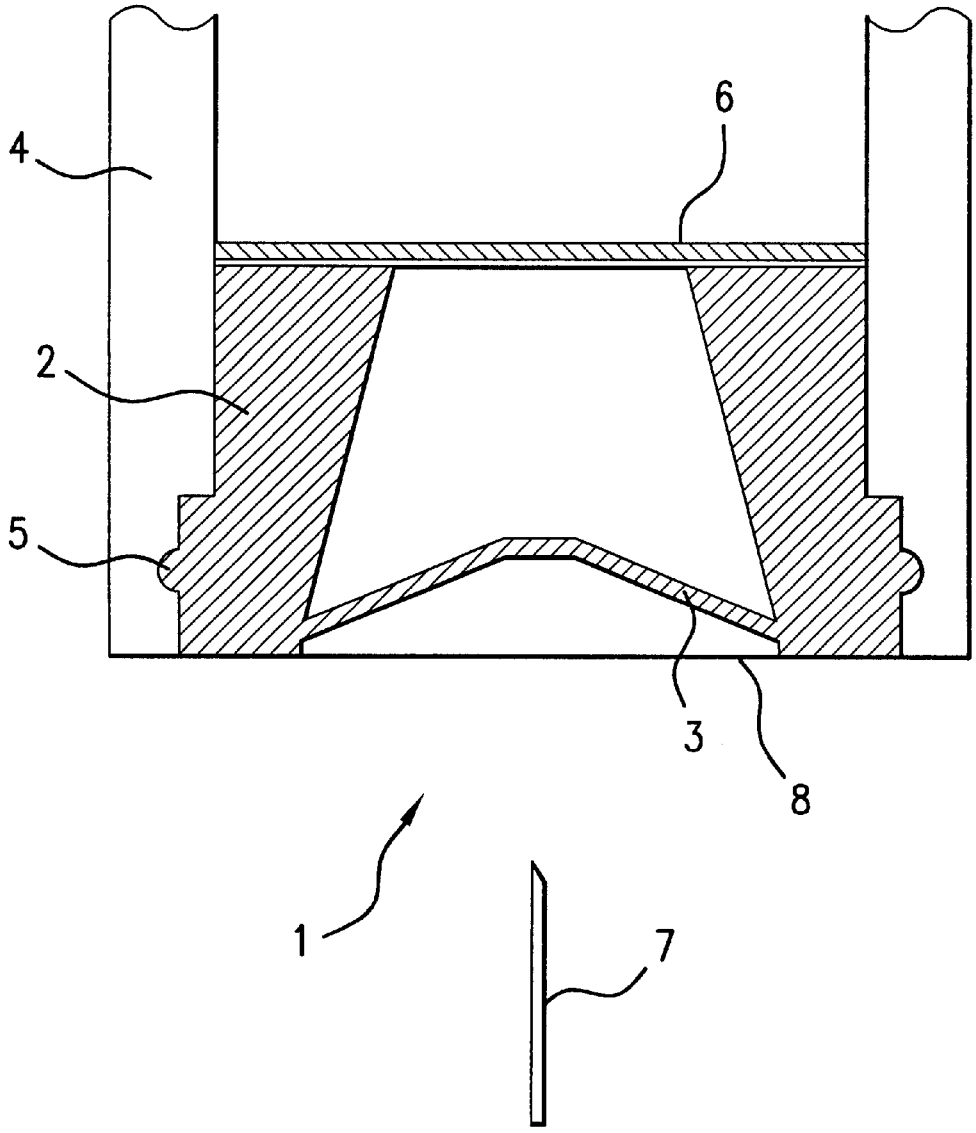

With the design mentioned above, it is especially advantageous to have the ring-shaped part make up a preformed sealing structure for the arbor or the hollow needle.

First experimental results have shown that between approximately 10 weight-% and 20 weight-% inelastic, inorganic substances should be added to the elastomer.

To produce a membrane according to the invention, the inelastic, inorganic substance is admixed to the thermoplastic elastomer granulate prior to the injection molding. In order largely to suppress unwanted separation it is advantageous that the inelastic, inorganic substance be admixed in the form of a batch granulate that is comprised of an elastomer with a relatively high fraction of the inelastic, inorganic substance, for example, 50%–80%.

A membrane according to the invention is shown in FIG. 1 in section, and is therein provided in its entirety with reference number 1. It consists of a ring- or bushing-shaped part 2, which is designed as one piece with the piercing region 3, which is as thin as film. The membrane 1 is attached at the outlet 8 of a tubular dome 4 and covered on the inside by a filter screen 6.

In the drawing, the membrane 1 is shown inserted axially from below into the outer end of a tubular dome 4 of an ink cartridge that is not shown. The positive-engagement elements 5 formed onto the outer circumference of membrane 1 provide for a secure axial hold, so that the membrane 1 is not inadvertently pressed into the dome during the insertion of an arbor.

As a result of the reduced elasticity of the membrane 1 according to the invention, the piercing region 3 can be penetrated with certainty even by a relatively dull hollow needle in the insertion depth that is available. Because of the nearly undiminished Shore hardness, the sealing is sufficient to seal the hollow needle.

What is claimed is:

1. An ink cartridge for an inkjet printing system comprising:

an outlet closed off by a membrane that is made of thermoplastic elastomer and that can be pierced by a hollow needle when inserted into the inkjet printing system, said membrane is made of a thermoplastic elastomer that has an elongation at tear that is reduced by means of added inelastic, inorganic substances.

2. An ink cartridge according to claim 1, wherein said elongation at tear of said membrane amounts to approximately 100%.

3. An ink cartridge according to claim 1, wherein talcum is added as the inelastic, inorganic substance.

4. An ink cartridge according to claim 1, wherein chalk is added as the inelastic, inorganic substance.

5. An ink cartridge according to claim 1, wherein silicic acid is added as the inelastic, inorganic substance.

6. An ink cartridge according to claim 1, wherein between 10 weight-% and 20 weight-% inelastic, inorganic substance is added to the elastomer.

7. An ink cartridge according to claim 1, wherein said membrane has a ring-shaped part that is closed off by a piercing region having less material thickness.

8. An ink cartridge according to claim 1, wherein said membrane is attached at said outlet, said outlet being part of a tubular dome, which is covered on the inside by a filter screen.

9. An ink cartridge for an inkjet printing system comprising:

an extraction opening closed off by a membrane that is made of thermoplastic elastomer and that can be pierced by a hollow needle when inserted into the inkjet printing system, said membrane is made of a thermoplastic elastomer that has an elongation at tear that is reduced by means of added inelastic, inorganic substances wherein said inorganic substance contains particle-shaped solids.

10. A method for producing an ink cartridge comprising:

mixing an inelastic, inorganic substance to thermoplastic elastomer granulate, molding the elastomer into a membrane, and attaching said membrane to an outlet of said ink cartridge.

11. The method according to claim 10, wherein said inelastic, inorganic substance is admixed in the form of a batch granulate that is comprised of an elastomer with a relatively high fraction of the inelastic, inorganic substance.

* * * * *